United States Patent [19]

O'Hori

[11] 4,247,013

[45] Jan. 27, 1981

[54] DRIP BAR FOR BRUSHES

[76] Inventor: Hiroshi D. O'Hori, 150 Ridgedale Ave., Morristown, N.J. 07960

[21] Appl. No.: 61,513

[22] Filed: Jul. 27, 1979

[51] Int. Cl.[3] ..... B65D 25/00

[52] U.S. Cl. ..... 220/90; 15/257.05; 220/354; D7/187

[58] Field of Search ..... 220/90, 254; D9/289; D7/181, 185; 401/121; 15/142, 256.5, 257, 257.05

[56] References Cited

U.S. PATENT DOCUMENTS

| | | | |
|---|---|---|---|
| 375,517 | 12/1887 | Vogel | 220/90 |
| 1,760,722 | 5/1930 | Sill | 220/90 |
| 2,109,803 | 3/1938 | Prince et al. | 220/90 |
| 2,184,460 | 12/1939 | Linder | 220/90 |
| 2,284,901 | 6/1942 | Hill | 220/90 |
| 2,355,549 | 8/1944 | Myers | 220/90 |

FOREIGN PATENT DOCUMENTS

| | | | |
|---|---|---|---|
| 1038249 | 9/1953 | France | 220/90 |
| 311603 | 5/1929 | United Kingdom | 220/90 |

*Primary Examiner*—Allan N. Shoap
*Attorney, Agent, or Firm*—Kenyon & Kenyon

[57] ABSTRACT

The drip bar for wiping excess paint, lacquer and similar materials from brush-type applicators when used in connection with a lip-type container for such material having an elongated member adapted to extend across the opening of the container and two tangs each secured adjacent to one end of the elongated member. The tangs are adapted to engage the upper surface of the lip of the container and two projections each extending from opposed ends of the elongated member are adapted to engage the under surface of the lip, thereby securing the drip bar above and below the lip to prevent vertical displacement.

11 Claims, 8 Drawing Figures

Fig. 1.
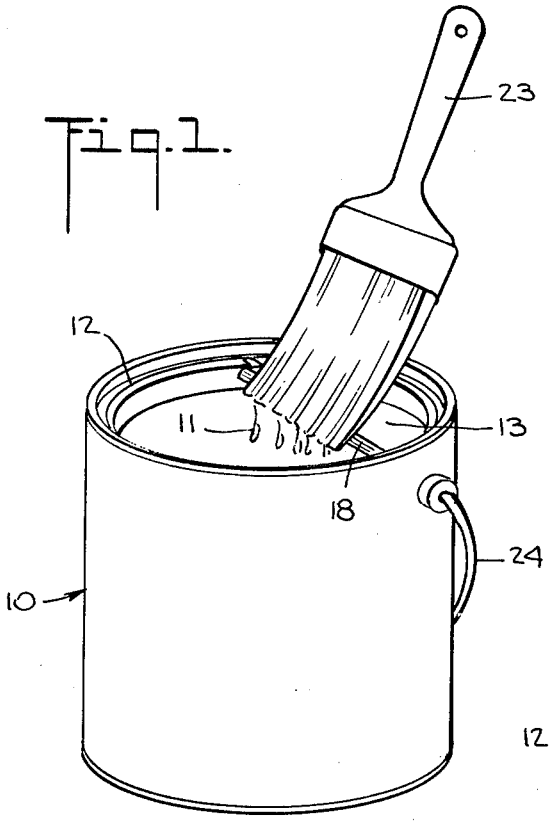
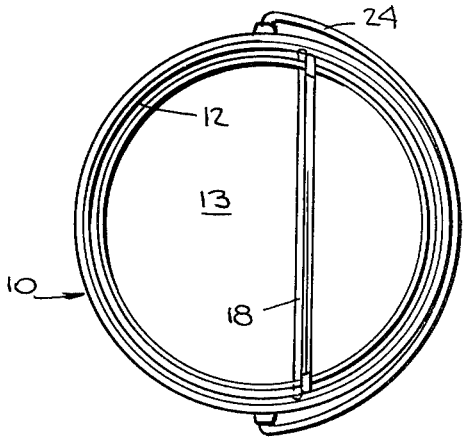
Fig. 2.
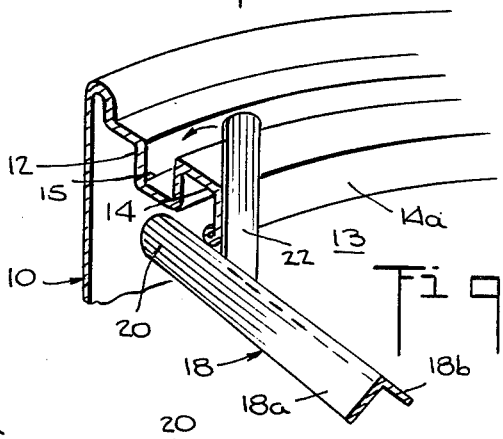
Fig. 4.
Fig. 3.
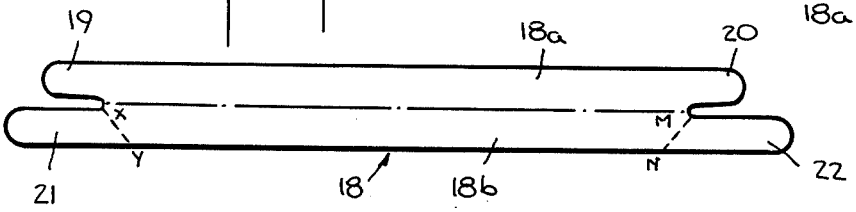
Fig. 5.
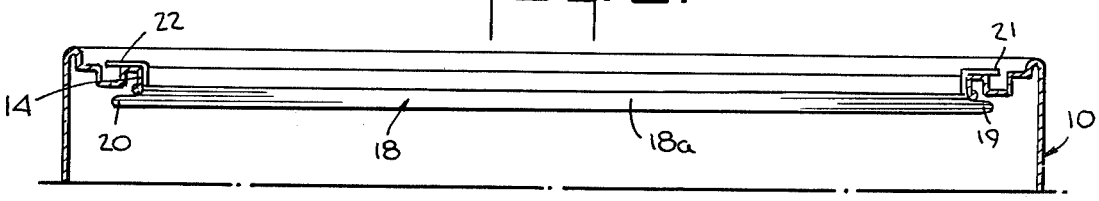
Fig. 6.
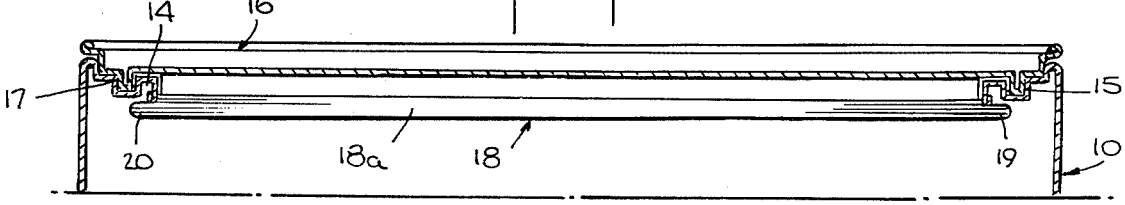

DRIP BAR FOR BRUSHES

This invention relates to a drip bar for brushes. More particularly, this invention relates to a drip bar for mounting on a container of fluid material, such as paint, varnish and lacquer, to allow removal of excess material from a brush or brush-type applicator dipped into the container.

Generally, cans or containers for paints, lacquers and similar materials are constructed with an opening around which is formed a radially inward extending lip with an annular groove for receiving a lid to close the opening and seal the container to protect the contents from spoilage. Usually, the lid has a flange which is frictionally engaged within the groove.

Typically, during the process of applying the materials in the container to a surface to be coated, a brush is dipped into the container and then drawn against the lip to remove excess material from the brush. Invariably, some of the excess material so removed becomes lodged in the annular groove of the container. This condition causes several problems. First, any material that accumulates in the groove prevents the lip flange from exactly registering with the lip groove. This may well destroy the desired seal, without which the material in the container may spoil. Second, in replacing the lid, some of the excess material in the groove may be forced out of the groove and run down the sides of the container thereby creating a likelihood that the material will come in contact with persons or objects not intended to be covered with the material. Third, after the container has been recovered and stored for some period of time, the remaining excess material in the groove may solidify so as to cement the lid to the container, thereby making a later removal of the lid for use of the remaining material difficult. Fourth, the material lodged in the groove is not used and thereby wasted.

In addition, since a container lip is usually curved and the brush is straight, it is often difficult to uniformly remove excess material from a brush by drawing the brush against the lip as excess material tends to be left near the middle of the brush.

Prior art solutions to some of these problems are illustrated in U.S. Pat. Nos. 2,491,482; 2,941,692; 2,903,154; and 3,016,169. These patents disclose various bulky ring assemblies for placement over the entire container lip and a brush wiping surface integral with said ring which extends into or across the container opening.

Accordingly, it is an object of the invention to provide a drip bar for a paint can or the like which is simple and inexpensive to manufacture and which is simple to use.

It is another object of the invention to provide a drip bar for a paint can over which a paint brush may be easily moved to remove excess paint.

It is another object of the invention to provide a drip bar for a paint can which can be easily attached to the paint can.

It is another object of the invention to provide a drip bar attachment for a paint can or the like which is easily removed.

It is another object of this invention to provide a drip bar for use in connection with containers for paints, lacquers and similar material which will help avoid accumulation of the contents of the container on the lip of the container.

It is another object of this invention to provide a drip bar which allows a brush-type applicator laden with the contents of the container to be drawn across the drip bar so as to uniformly remove the excess contents from the applicator and to re-deposit the excess contents into the container.

It is another object of this invention to provide such a drip bar which is disposable.

Briefly, the invention provides a drip bar which is comprised of an elongated member for mounting across an opening of a container and a pair of tangs, each of which is disposed adjacent to a respective end of the elongated member for securing the member to the container.

In one embodiment, the drip bar is of integral one-piece construction and is made, for example, of thin metal. In this embodiment, the elongated member is a one-piece body having a pair of legs which define a V-shaped intermediate portion and a tab at each end of one leg which extends from the leg. In addition, each tang is disposed at a respective end of the other leg, and extends therefrom in spaced parallel relation to the tab at that end. The one-piece body also has a fold line extending angularly near each end of the leg from which the respective tang extends in order to permit an upward bending of the tang into transverse relation to the V-shaped intermediate portion.

As constructed, the tangs are longer than the respective tabs at the respective ends of the drip bar.

The drip bar is utilized with a can, for example, a paint can having an annular rim defining a channel or groove and an interior annular wall. In this regard, the drip bar is disposed across the can in chordal relation to the annular wall. In this position, the V-shaped intermediate portion is inverted and the tab at each end of the drip bar underlies the rim while the upstanding tang at each end abuts the vertical wall.

In order to utilize the drip bar, the paint can is initially opened by removing the usual lid or cover. Thereafter, the tangs at the respective ends of the drip bar are bent upwardly about the respective fold lines. Next, the drip bar is slid into place with the tabs at each end underlying the rim and the upstanding tangs abutted against the vertical wall of the rim. The drip bar is forced into place and is retained therein by means of a friction fit. If required, each tang may be bent downwardly into the channel of the rim so as to further secure the drip bar in place.

After the drip bar has been fixed in place, a brush such as a paint brush can be dipped into the can to remove the contents. Excess paint or the like on the brush may be removed by sliding the brush over the leg of the drip bar facing towards the center of the can. In this regard, the legs of the drip bar are disposed so that the inwardly facing leg attains an attitude of about 45° to the horizontal plane.

By running the brush over the drip bar, excess paint is easily wiped off from the underside of the brush. If paint is desired to be removed from the upper surface of the brush, the brush can be turned over and run a second time over the drip bar. Also, only the forward end of the upper surface may be pulled across the lower edge of the second outwardly facing leg of the drip bar.

In order to replace a lid on a partially used paint can, the upstanding tangs are folded down into the channel of the rim and the cover then replaced. In this regard, the thickness of the tang is such as to permit reinsertion of the cover into the channel.

The one-piece drip bar can be made of any suitable material, for example strip steel, and of a suitable thickness, for example in the case of strip steel, of a thickness of 0.010 inches, to permit bending of the tangs. In this regard, a one piece body may be stamped out and subsequently folded along a longitudinal center line to define a V-shaped intermediate portion. At the same time, the tab and tangs at each end of the drip bar can initially be made by stamping with a space or gap of for example 1/16 of an inch to 1/32 of an inch spacing therebetween. The scoring line required for bending of the respective tangs may also be made during the initial formation of the drip bar and prior to shaping into a V-shaped portion.

The scoring line is disposed on the leg of the drip bar so as to permit each tang to be bent into a right angle relative to the remainder of the drip bar.

The V-shaped cross-section of the intermediate portion of the drip bar imparts strength to the bar when disposed in place across a paint can.

In another embodiment, the drip bar can be made of multiple piece construction. For example, the elongated member is made of a material, such as plastic, with a solid or hollow cross-section while the tangs are separately made, for example of a suitable flexible material (e.g., strip steel 0.010" thick) and are slidably mounted on the elongated member. When the elongated member is placed across the container opening, the tangs can be shaped to fit snuggly against the upper surface of the lip of the container thus supporting the member horizontally across the opening, approximately in the plane of the container opening. The end portions of the elongated member extend outwardly beyond the point where the tangs extend from the member so that when the bar is in place across the container opening, these end portions engage the under surface of the lip thus preventing vertical displacement of the bar when a brush or the like is wiped against the member to remove excess paint, lacquer, etc., as the case may be. The member is preferably made of an inexpensive material impervious to the contents of the container.

The invention thus provides a straight surface across the container opening against which a brush-type applicator can easily be wiped to uniformly remove excess paint, etc., from the applicator. The excess material thus removed from the applicator will, through the effects of gravity, drip off the bar and into the container.

By positioning the drip bar chordally relative to the opening of the paint can, a sufficient space is allowed to permit a maximum width brush to be placed in the can. The chordal disposition of the drip bar also avoids any obstruction of the brush even if the handle of the paint can is in the way.

The invention thus provides a drip bar which can be easily and inexpensively made. Further, because the drip bar can be made of a simple shape and of relatively small dimensions, a multiplicity of such drip bars can be packaged and sold on a commercial basis e.g. as disposable items. Still further, the drip bar can be easily affixed to a can and subsequently removed.

It is further noted that the drip bar can be used not only for the conventional circular type of container, but also may be used for rectangular or other polygonal shaped lipped containers.

These and other objects and advantages of the invention will become more apparent from the following detailed description and appended claims taken in conjunction with the accompanying drawings in which:

FIG. 1 illustrates a perspective view of a paint can employing a drip bar in accordance with the invention;

FIG. 2 illustrates a plan view of the paint can drip bar of FIG. 1;

FIG. 3 illustrates a plan view of a drip bar in accordance with the invention;

FIG. 4 illustrates a partial cross-sectional perspective view of a drip bar in place in a paint can in accordance with the invention;

FIG. 5 illustrates a cross-sectional view of a drip bar in place on an opened paint can in accordance with the invention;

FIG. 6 illustrates a drip bar in place on a closed paint can in accordance with the invention;

Figure 7:
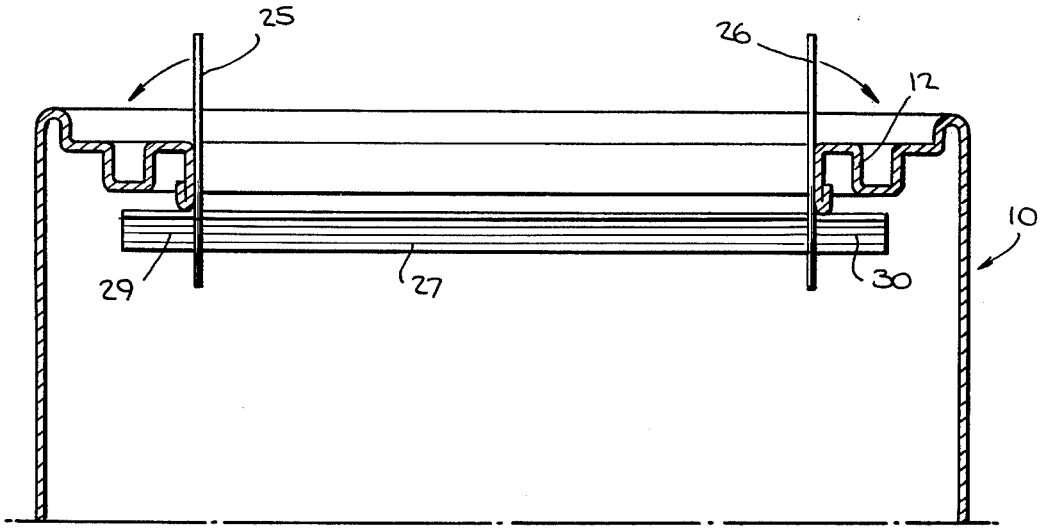
FIG. 7 illustrates a cross-sectional view of a further embodiment of a drip bar according to the invention in place in a container.

Referring to FIGS. 1 and 4, a standard-type can or container 10 for materials 11 such as paint, lacquer, varnish has a radially inward disposed annular rim or lip 12 defining a circular container opening 13. The lip 12 also defines an upstanding peripheral ring 14 having a vertical annular wall 14*a* and a concentric recessed annular groove or channel 15 for receiving a lid 16 to close the opening 13 for transportation and storage. The lid 16 has an annular flange 17 adapted to frictionally engage upstanding walls of the groove 15.

A drip bar 18 is mounted across the opening 13 of the container 10. As shown in FIGS. 3 and 4, the drip bar 18 has an elongated member in the form of a one piece body having a pair of legs 18*a*, 18*b* defining a V-shaped intermediate portion and a tab 19, 20 extending from each end of one leg 18*a*. In addition, the drip bar 18 has tangs 21, 22 which extend from either end of the other leg 18*b*. The tangs 21, 22 are adapted to be pivoted upwardly along score lines X–Y, M–N respectively relative to the intermediate portion and bent or shaped to fit snuggly over the ring 14 into the groove 15 of the container 10. The tabs 19, 20 extend outward in such a fashion that, when the drip bar 18 is properly supported by the tangs 21, 22 across the container opening 13, the tabs 19, 20 engage the under surface of the lip 12, thus preventing upward vertical displacement of the drip bar 18 when a brush 23 is drawn against the bar 18 to remove excess material 11.

The drip bar 18 can be made for example by stamping from a single piece of material such as strip steel of a thickness of 0.010" which allows for the flexibility needed to pivot and shape the tangs 21, 22 into position to support the drip bar 18.

The "V" shape of the drip bar 18 imparts adequate rigidity to the bar 18 to withstand the pressure of the brush 23 when the brush 23 is wiped across the bar 18 to remove excess material 11.

The combined length of the leg 18*a* and tabs 19, 20 should preferably be less than the inside diameter of the container 10 so that the bar 18 can be placed in position chordally across the opening 13 without intersecting the center-point of the opening 13. This allows the maximum brush width permitted by the container 10 to be used and avoids obstruction of the brush 23 even if a handle 24 of the container 10 is in a vertical position over the opening 13 which is the case when the container 10 is being held by the handle 24.

The drip bar 18 can be made in varying lengths to fit the various standard size containers (e.g. gallon, quart).

The score lines X–Y, M–N are preferably made at an acute angle with the axis of the bar 18 so that the tangs 21, 22 when pivoted upward will be virtually flush against the inside annular wall 14*a* of the ring 14.

Thus, each tang 21,22 defines supporting means to prevent the bar 18 from falling into the can or container 10 by being adapted to be bent over a portion of the can rim. Also, each tab 19,20 defines anchor means for placement under the can rim.

Referring to FIGS. 5 and 6, the tangs 21, 22 can initially be manually bent flat over the upper surface of the ring 14 (FIG. 5) and subsequently bent against the radially inward vertical wall of the groove 15 (FIG. 6), when the lid 16 is fitted into place on the container. In this case, the lid flange 17 will engage the tangs 21, 22 and shape the tangs 21, 22 to fit snuggly over the upper surface of ring 14 and against the radially inward vertical wall of the groove 15, thus, further securing the bar 18 in place.

Moreover, because the tangs 21, 22 are made of a thin material, for example of approximately 0.010 inch thickness, the bar 18 can be left in place across the container opening 13 with the lid 16 closed for further use when the lid 16 is subsequently removed.

Figure 8:
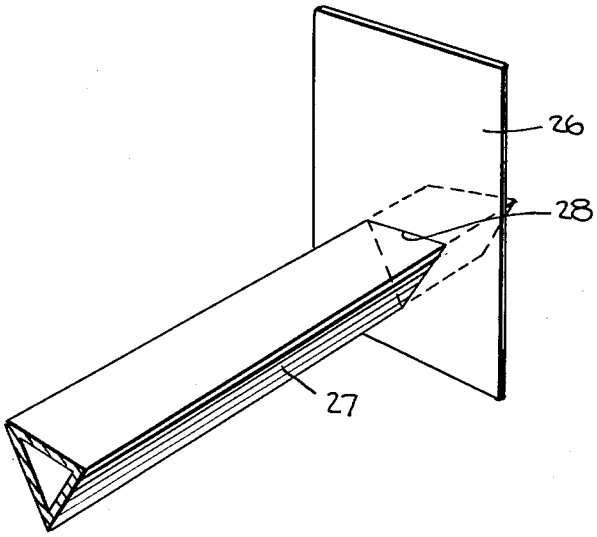
FIG. 8 illustrates a part perspective view of the drip bar of FIG. 7.

Referring to FIGS. 7 and 8, the drip bar can alternatively be made of multi-piece construction. For example, the drip bar may have tangs defined by plates 25, 26 and an elongated member 27 which are separate pieces from each other. As shown in this case, the tangs 25, 26 are slideably secured to the member 27 in a transverse relationship. To this end, the elongated member 27 is made with a cross-section, e.g. of triangular shape, and each tang 25, 26 has an aperture 28 conforming to the shape of the member 27 via which the tang 25, 26 can be slid over one end of the member 27.

In this embodiment, the tangs 25, 26 are made of the same type of flexible material and engage the upper surface of the lip of a container 10 as described above. The member 27 is positioned in place so that the apex edge points downward (FIG. 8) to encourage the redepositing of the excess material wiped off a brush into the container 10.

As shown in FIG. 7, the elongated member 27 has extensions or tabs at each end which extend beyond the tangs 26, 27 and engage the under surface of the container lip 13 in a fashion similar to the tabs described above.

The elongated member 27 can be shortened to fit a smaller container by simply cutting the member 27 to the desired length and sliding the tangs 26, 27 inwardly to accommodate the smaller opening of such a smaller container.

What is claimed is:

1. A drip bar comprising a plastic elongated member of triangular cross-section for mounting across an opening of a container; and a pair of tangs each defined by a plate slidably mounted on said member, each said tang being disposed adjacent to a respective end of said elongated member for securing said member to the container and being of a material capable of being manually bent.

2. A drip bar for a can having an annular inwardly extending rim, comprising a one-piece body having a pair of legs defining a V-shaped intermediate portion, a tab at each end of one leg extending from said one leg in the same plane thereof beyond the juncture of said pair of legs, and a tang at each end of the other leg defining an extension of said other leg in spaced parallel relation to said tab, each said tang being of a longer length than a respective tab at one end of said body and being made of a material capable of being manually bent into perpendicular relation to said V-shaped portion, each tang defining supporting means to prevent said bar from falling into the can by being adapted to be bent over a portion of the container rim, each tab defining anchor means for placement under the can rim.

3. A drip bar as set forth in claim 2 wherein said body is made of strip steel.

4. A drip bar as set forth in claim 3 wherein said body is of a thickness of 0.010 inches.

5. A drip bar as set forth in claim 2 wherein said body has a fold line extending angularly near each end of said other leg to permit bending of said respective tang.

6. In combination, a can having an annular rim defining a groove and a vertical interior annular wall; and a drip bar having an elongated intermediate portion disposed across said can in chordal relation to said annular wall, an end portion at each end underlying said rim and an upstanding tang of manually bendable material at each end abutting said vertical wall and bent downwardly into said groove to secure said drip bar to said can, said intermediate portion having two connected legs forming an angle where they connect has been inserted.

7. The combination as set forth in claim 6 wherein said bar is made of one-piece metal.

8. The combination as set forth in claim 6 wherein said can has a lid mounted on said rim within said groove and wherein said tangs are deformably bent into said rim to permit said lid to be secured on said rim with said drip bar disposed across said can.

9. The combination as set forth in claim 6 wherein the combined length of said imtermediate portion and said end portions is less than the diameter of said can.

10. The combination as set forth in claim 6 wherein said drip bar is a one-piece body defining a V-shaped intermediate portion.

11. The combination as set forth in claim 6 wherein said intermediate portion has a third leg forming a triangular cross-section with an apex with said two legs.

* * * * *

UNITED STATES PATENT AND TRADEMARK OFFICE

CERTIFICATE OF CORRECTION

PATENT NO. : 4,247,013

DATED : January 27, 1981

INVENTOR(S) : Hiroshi D. Ohori

It is certified that error appears in the above—identified patent and that said Letters Patent is hereby corrected as shown below:

Page 1, item [76] O'Hori should be --Ohori--

Column 6, lines 37-38 after "connect" delete "has been inserted"

Signed and Sealed this

*Twenty-eighth* Day of *April 1981*

[SEAL]

*Attest:*

RENE D. TEGTMEYER

*Attesting Officer*

*Acting Commissioner of Patents and Trademarks*